US009725910B2

(12) United States Patent
Whitten

(10) Patent No.: US 9,725,910 B2
(45) Date of Patent: Aug. 8, 2017

(54) METHOD AND APPARATUS FOR DISTRIBUTING GRANULES ON A ROOF

(71) Applicant: John W. Whitten, Terrell, TX (US)

(72) Inventor: John W. Whitten, Terrell, TX (US)

( * ) Notice: Subject to any disclaimer, the term of this patent is extended or adjusted under 35 U.S.C. 154(b) by 71 days.

(21) Appl. No.: 14/702,366

(22) Filed: May 1, 2015

(65) Prior Publication Data

US 2015/0308122 A1 Oct. 29, 2015

Related U.S. Application Data

(62) Division of application No. 14/092,435, filed on Nov. 27, 2013, now Pat. No. 9,051,737.

(60) Provisional application No. 61/730,742, filed on Nov. 28, 2012.

(51) Int. Cl.

| | |
|---|---|
| ***E04D 15/07*** | (2006.01) |
| ***E04D 5/12*** | (2006.01) |
| ***B05C 19/04*** | (2006.01) |
| ***B05C 19/00*** | (2006.01) |
| ***E04D 7/00*** | (2006.01) |
| *B65D 83/06* | (2006.01) |
| *B65D 47/20* | (2006.01) |

(52) U.S. Cl.

CPC ..... *E04D 15/07* (2013.01); *B05C 19/005* (2013.01); *B05C 19/008* (2013.01); *B05C 19/04* (2013.01); *E04D 5/12* (2013.01); *E04D 7/005* (2013.01); *B65D 47/2031* (2013.01); *B65D 83/06* (2013.01)

(58) Field of Classification Search

CPC E04D 7/005; E04D 5/12; E04D 15/07; B05C 19/005; B05C 19/008; B05C 19/04; B05C 19/06; B65D 47/2031; B65D 83/06

USPC ..... 118/308; 141/231, 232; 222/608, 509, 222/531, 532, 537, 559, 462; 239/650, 239/668, 687, 379; 404/101–110

See application file for complete search history.

(56) References Cited

U.S. PATENT DOCUMENTS 1,491,624 A * 4/1924 Polk ..... A01C 15/12 111/76

2003/0198736 A1 10/2003 Fensel et al.

2006/0037710 A1 2/2006 Vaillancourt

OTHER PUBLICATIONS

Office Action issued Oct. 14, 2014 for U.S. Appl. No. 14/092,435, 8 pages.

* cited by examiner

*Primary Examiner* — Laura Edwards

(74) *Attorney, Agent, or Firm* — Haynes and Boone, LLP

(57) ABSTRACT

A method for distributing granules may include transporting a hopper along a roof while releasing granules through a valve of the hopper, thereby depositing a line of granules on the roof. Another method for distributing granules may include adjusting a valve of a container mounted on a cart, depositing a predetermined width of the granules though the valve onto the roof while driving the cart along a roof, and covering a seam between adjacent sheets of roofing material with the granules. A device for depositing granules on a roof may include a hopper, and a valve, where granules stored in the hopper flow directly through the valve to the roof in response to gravity when the valve is at least partially opened, and where the flow of the granules is not assisted by an agitator, an auger, or air pressure.

5 Claims, 6 Drawing Sheets

FIG. 1
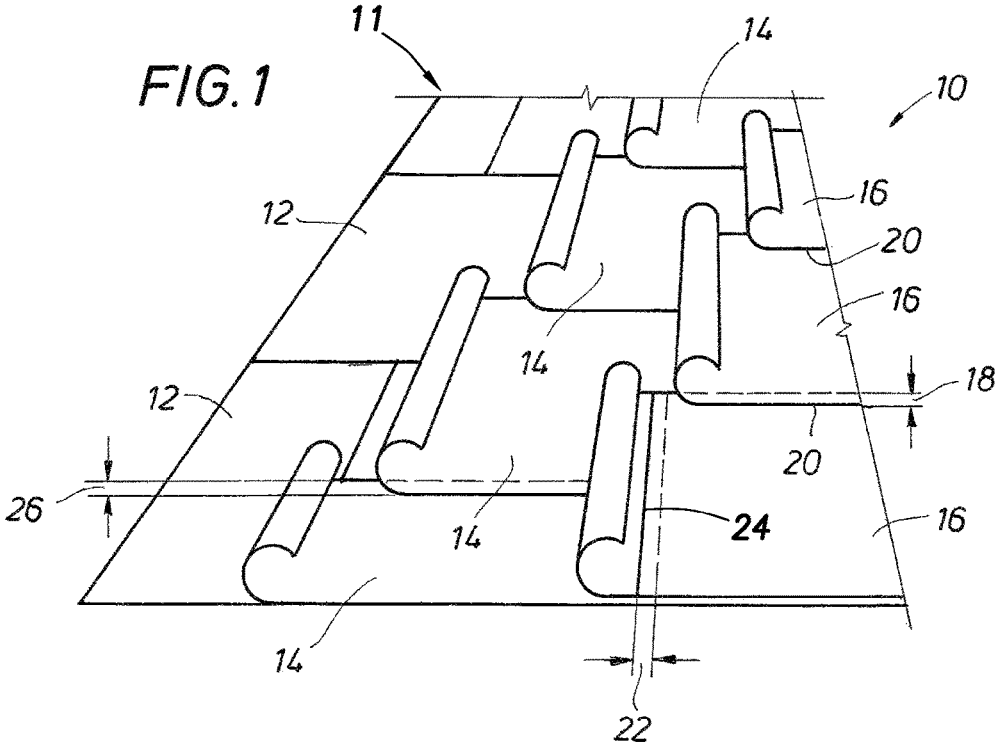
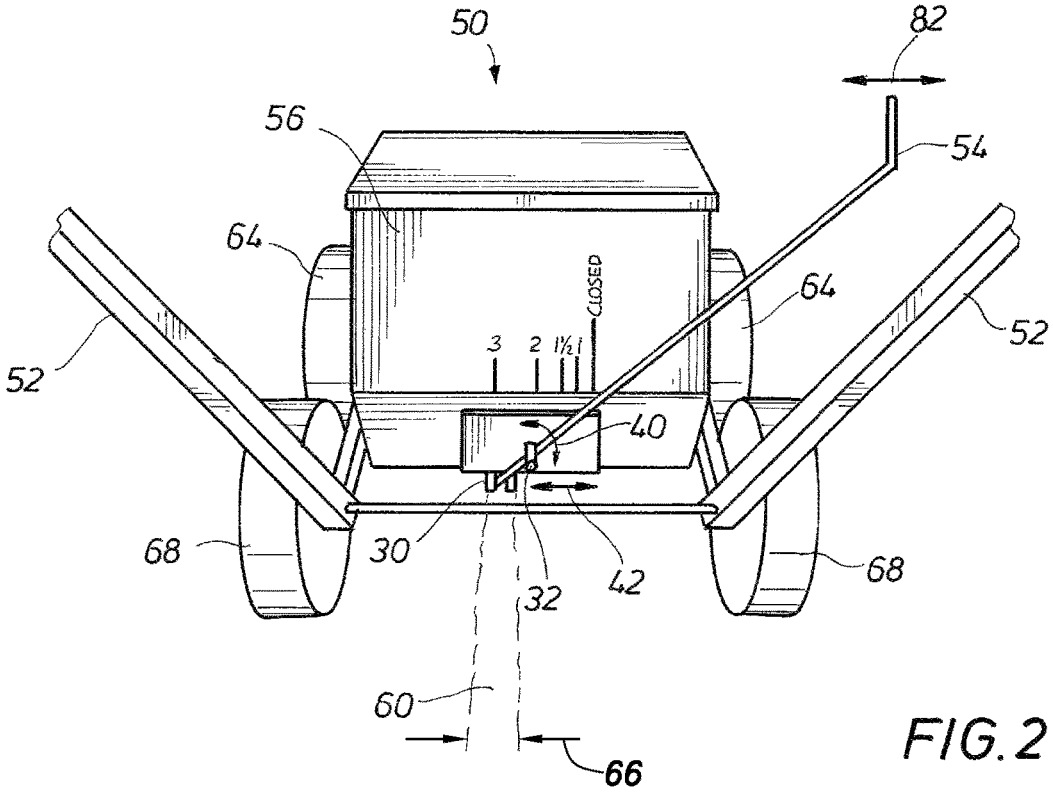
FIG. 2

METHOD AND APPARATUS FOR DISTRIBUTING GRANULES ON A ROOF

CROSS-REFERENCE TO RELATED APPLICATIONS

This application is a division of prior application Ser. No. 14/092,435 filed on 27 Nov. 2013, now U.S. Pat. No. 9,051,737 which claims priority to a U.S. Provisional Application No. 61/730,742 filed on 28 Nov. 2012. The entire disclosures of these prior applications are incorporated herein by this reference.

BACKGROUND

This disclosure relates generally to roofing systems for low slope roofs (including flat roofs) and, in an example described below, more particularly provides a device for distributing granules on a low slope roof for protecting portions of the roof from various environmental conditions.

There are several types of roofing systems used to cover a low slope roof. An underlayment is generally constructed of multiple layers that provide strength, insulation, and some degree of weatherproofing for the roof. The exterior layer is exposed to the most damaging environmental conditions, such as the sun's UV rays, rain, temperature extremes, hail, ice, wind, etc. Therefore, this layer provides the first line of defense against these conditions and generally determines the useful life of the roofing system.

One roofing system for covering low slope roofs uses poured asphalt with pea gravel covering the poured asphalt. The asphalt is heated until it can be poured onto the roof and then cooled after it is smoothed out to provide waterproofing for the roof system. Pea gravel may then be distributed over the asphalt to provide protection for the asphalt from environmental conditions.

A modified bitumen system was developed in Europe during the sixties and introduced in the U.S. in the early seventies. The term modified refers to the addition of plastic or rubber-based polymeric binders to asphalt for improving its performance and durability. Modified bitumen is a multiple layer system and is essentially a "factory assembled" build-up roof. Several coats or laminations of modified bitumen may be used as a reinforcing mat, which is often covered with a granule-surface cap sheet, or left smooth for aluminum or white coating to be applied.

These granule-surface cap sheets may be individually installed on the roof by applying an adhesive to the roof and rolling out the individual sheet over the adhesive. Alternatively, the cap sheets may be installed by heating a bonding material (e.g. asphalt, an adhesive, etc.) on a backside of the sheet until it is soft and rolling the cap sheets with the heated bonding material onto the roof. The heated bonding material will then adhere to the roof and secure the sheet to the roof.

Installation of subsequent sheets of the roofing material may be performed by 1) overlapping a portion of the new sheet over an adjacent previously installed sheet, 2) applying an adhesive to the roof and/or heating the bonding material of the sheet, and 3) rolling out the individual sheet onto the roof while maintaining the relative overlap between the two adjacent sheets. The edge of the top sheet in the overlapped region may be referred to as a seam of the roofing system 10 (see FIG. 1).

The seam may also include bonding material that may ooze from the overlapped region onto the roof. The bonding material may not be suited to withstand the harmful environmental conditions without additional preparation.

Therefore, these roofing systems generally cover the seams with the same type of granules used on the granule-surfaced cap sheets. This serves to match the color and texture of the rest of the roof, to prevent operators from tracking the oozed adhesive around the roof, and to protect the oozed adhesives and/or asphalt on the seams from the harsh environmental conditions, thereby extending the useful life of the roofing system.

Unfortunately, the usual method for distributing these granules is for laborers to carry the granules in a bucket (or suitable container) onto the roof and scatter the granules by hand along the seams to cover the seams with the granules. This approach is very labor intensive and may result in inefficient and inconsistent distribution of the granules. Therefore, it may be seen that improvements in the art are needed.

BRIEF DESCRIPTION OF THE DRAWINGS

FIG. 1 is a representative perspective view of a roofing system which can benefit from the principles of this disclosure.

FIG. 2 is a representative rear perspective view of a granule distribution device which can embody principles of this disclosure.

DETAILED DESCRIPTION

Figure 3:
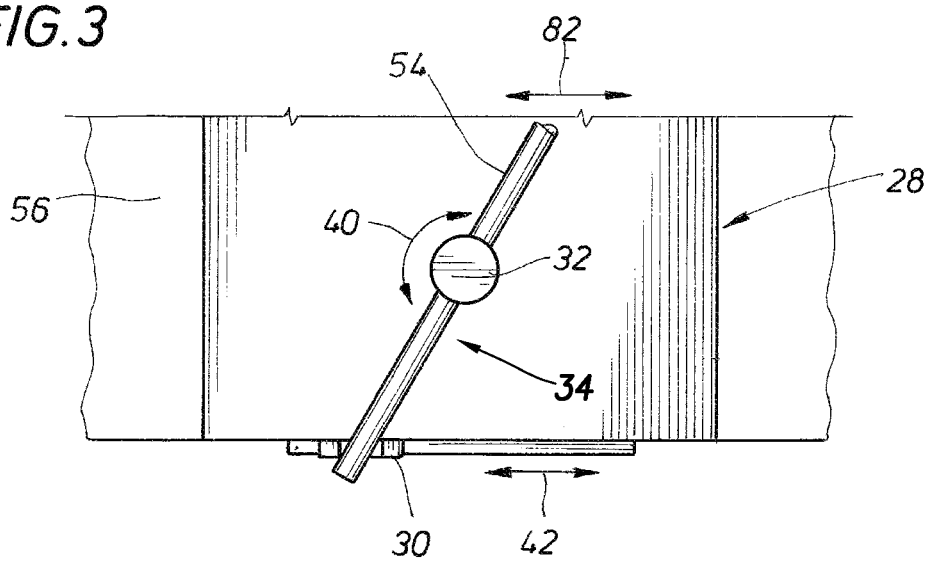
FIG. 3 is a representative perspective view of a valve portion of the device of FIG. 2.

Representatively illustrated in FIG. 1 is a roofing system 10 used to cover a low slope roof 11. This type of roofing system 10 is generally referred to as a build-up roof (BUR). A BUR is a roofing system 10 that builds up successive layers of sub-structure and weatherproofing to cover a roof 11 on a building or other structure.

A BUR system 10 generally includes a base structure (not shown) such as metal panels that may be welded or otherwise fastened to rafters of a building or other structure. When at least a portion of the base structure is installed, installation of an insulation layer 12 may begin. After at least a portion of the insulation layer 12 is installed, installation of successive layers of adhesive and/or base sheets 14 may begin.

As seen in FIG. 1, the base sheets 14 are installed such that adjacent base sheets 14 may overlap each other. For example, the overlap 26 may be between 2 and 5 inches wide. However, it is not required that the overlap 26 be between 2 and 5 inches wide.

An adhesive layer may be installed and/or applied to the roof prior to placing a base sheet 14 onto the roof. The adhesive may be used to adhere the base sheets 14 to the roof without using fasteners that penetrate the sheets. However, fasteners may also be used to fix the base sheets 14 to the roof. Several adhesives may be used for this purpose. These adhesives are well known in the art and will not be described in more detail.

Alternatively, or in addition to, one side of each base sheet 14 may include the adhesive that is used to adhere the sheets to the roof 11. The adhesive may be heated to facilitate flowing and bonding of the material to the roof 11 and/or other base sheets 14. Also, the adhesive may be cold flow adhesive, therefore, not requiring heat to be applied for bonding.

The final layer of roofing material may be installed after at least a portion of the base sheets 14 is installed. The final layer may include sheets of roofing material that are referred to as cap sheets 16. These at least differ from the base sheets 14 in that they provide a side that is more resistant to damages from environmental conditions than the base sheets. For example, these cap sheets 16 may have a layer or layers of granules 62 adhered to at least one side. These granules 62 substantially cover the one side of the cap sheets 16. The one side may also be covered with a coating that is suitable for withstanding environmental conditions.

These cap sheets 16 may be installed similarly to the base sheets 14. As adjacent cap sheets 16 are installed, they overlap adjacent sheets 16 and are adhered to the roof 11 by at least an adhesive. Again, the adhesive may be applied to the roof 11 prior to installing a cap sheet 16 and/or the adhesive may be a bottom layer of the cap sheets 16. Some adhesive may ooze from underneath an overlap 18, 22 between adjacent cap sheets 16 when the sheets are installed. This adhesive that has oozed out may be referred to as a seam 20 or cross-seam 24. These seams 20, 24 would most likely remain exposed to the environmental conditions throughout the life of the roof 11, if further precautions were not taken.

Figure 5A:
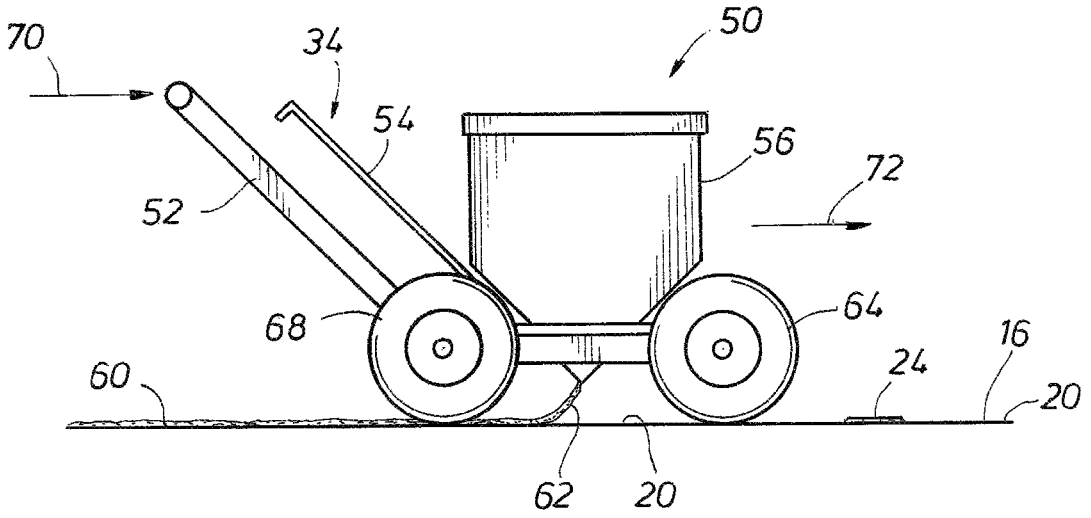
FIGS. 5A-D are representative elevation views of the device in various positions of distributing granules onto a roof.

To further protect the roofing system and extend its useful life, loose granules 62 (see FIGS. 5A and 6) are generally deposited along the seams 20, 24 to cover the exposed adhesive with a line 60 of deposited granules 62 (see FIG. 5A). These are generally the same type granules used in making the granule-surfaced cap sheets 16, and therefore, would preferrably match both color and texture of the cap sheets 16 when deposited on the roof 11 along either of the seams 20, 24 and covering these seams. However, it is not required that these granules 62 match either color or texture of the granules on the granule-surfaced cap sheets 16. Any suitable granules may be used to cover these seams 20, 24 in keeping with the principles of this disclosure.

An accepted process for distributing these loose granules 62 is generally known to those skilled in the art as "feeding the chickens." This is because laborers manually scatter these loose granules 62 from partially filled buckets (or suitable containers) which they carry around the roof. This process may be labor intensive and may cause a significant amount of granules 62 to be wasted.

The principles of the present disclosure provide a device 50 and related methods for a more efficient process of distributing loose granules 62 along the seams 20, 24 on these types of build-up roofs. However, this device 50 and related methods may also be used in other applications and are not restricted to build-up roofs or low slope roofs.

Referring now to FIG. 2, one example of a granule distribution device 50 is shown with front wheels 64, rear wheels 68, a handle 52, a lever 54, a hopper 56, a pivot 32, and a valve 28 with a closure member 30. The hopper 56 is mounted to a chassis 38 with four wheels 64, 68 rotatably attached to the chassis. An upper portion of the hopper 56 is shown in FIG. 2 as being generally rectangularly shaped, with a lower portion that is V-shaped.

However, it can readily be seen that other shapes, such as circular, oval, square, triangular, etc. may also be used in keeping with the principles of this disclosure. Each of these shapes would have a slotted exit at the bottom of the hopper 56 for depositing the loose granules 62 on to the roof 11 due to gravity induced flow out of the hopper. The internal walls 48 (see FIG. 6) of the hopper 56 are preferably inclined toward the exit 36 so that the granules 62 stored in the hopper 56 will be urged through the exit in response to gravity acting on the granules 62.

Also, it is not required that four wheels 64, 68 be used with the device 50, as shown in FIG. 2. Any number of wheels may be used in keeping with the principles of this disclosure. For example, each wheel 64, 68 may include dual wheels, thereby increasing the carrying capacity of the device 50 and/or reducing the weight of the device 50 carried by each wheel. Additionally, there may be only one front wheel 64 and one rear wheel 68. In this example, the hopper 56 may be mounted on the chassis 38 to one side of the front and rear wheels, with the front and rear wheels 64, 68 mounted to the chassis in line with each other. A counter-balance may be mounted to the chassis on an opposite side of the front and rear wheels 64, 68 to offset the weight of the hopper 56 on the other side.

However, if the front and rear wheels are mounted to opposite sides of the chassis (e.g. with the front wheel 64 mounted to a front, right-side of the chassis and the rear wheel 68 mounted to a rear, left-side of the chassis), then a counter-balance may not be needed.

The preferred embodiment of the hopper 56 is a rectangularly shaped upper portion with a V-shaped lower portion. A closure member 30 may be slidably attached within the valve 28 which is positioned at a bottom of the hopper 56. As the closure member 30 is displaced from a closed position to at least a partially open position, granules 62 are released from the bottom of the hopper 56 through a slotted exit 36. This creates a ribbon of loose granules exiting the hopper 56. A width 66 of the ribbon may be determined by the position of the closure member 30 relative to the slotted exit 36.

When the closure member 30 is displaced a first predetermined distance, a first width of granules 62 is produced and deposited onto the roof 11. Displacing the closure member 30 a second predetermined distance, a second width of granules 62 is produced. As can readily be seen, displacing the closure member 30 to various positions may produce various ribbon widths of granules 62.

In the example shown in FIG. 2, the position of closure member 30 is controlled manually by using a lever 54 that is extended from the hopper 56 to a convenient location near an operator. The lever 54 is pivotably attached to the hopper 56 via pivot 32. Laterally displacing the lever 54 to the right or left as given by arrows 82 laterally displaces the closure member to the left or right, respectively (i.e. laterally in an opposite direction), as given by arrows 42.

FIG. 2 shows four predetermined lateral positions of the lever 54 marked on the hopper 56 where the lateral positions result in widths of 3 inches, 2 inches, 1½ inches, and 1 inch of granules 62 deposited on the roof 11. FIG. 2 shows the lever 54 in a closed position. When the operator is ready to begin depositing granules 62 onto the roof, he/she would move (or displace) the lever laterally to the left until it is placed at a desired position to produce a desired width 66 of granules 62 being deposited onto the roof 11. These predetermined positions are merely given as examples. It may readily be seen that many other positions are possible in keeping with the principles of this disclosure.

The internal walls of the hopper 56 are formed in such a way as to enable substantially all of the granules 62 to be removed from the hopper 56 in response to gravity acting on the granules. For example, the internal walls 48 may be inclined at an appropriate angle toward the exit to more efficiently remove the granules 62 from the hopper 56 to the slotted exit 36.

Additionally, the hopper 56 may have a circular shaped upper portion and a cone shaped lower portion (not shown), where the lower portion radially converges toward the exit and assists gravity in removing the granules 62 from the hopper 56. Additionally, the hopper 56 may have triangularly shaped upper and lower portions with the lower portion converging toward the exit and assisting gravity in removing the granules 62 from the hopper 56. Therefore, it can readily be seen that many different configurations of the hopper may be used in keeping with the principles of this disclosure.

The device 50 does not require a moveable element (e.g. an auger, an agitator, a conveying device, a spinning wheel, etc.) to facilitate and/or enable the removal of the granules 62 from the hopper 56, except for the closure member 30 of the valve 28. Moveable elements may be used to assist in the removal of the granules 62 from the hopper 56, but they are not required.

As stated above, the width 66 of the ribbon of deposited granules 62 may be determined by the position of the closure member 30. Additionally, a thickness of the deposited granules 62 may be determined by a speed of forward travel 72 (FIG. 5A) of the device 50. A slower speed of forward travel 72 may result in a thicker amount of granules 62 being deposited for each unit length of forward travel 72. A faster speed of forward travel 72 may result in a thinner amount of granules 62 being deposited for each unit length of forward travel 72.

Therefore, the width 66 and depth of the line 60 of the deposited granules 62 may be adjusted to provide the appropriate amount of deposited granules 62 on a roof 11 for covering the seams 20, 24 with the deposited granules 62.

Referring now to FIG. 3, the valve 28 is shown with an actuator 34 and a closure member 30. The actuator 34 may include a lever 54 pivotably attached to the hopper 56 via the pivot 32. As an upper portion of the lever 54 is displaced to the left or right (i.e. laterally shown by arrows 82), a lower portion of the lever 54 is displaced in an opposite direction (i.e. laterally shown by arrows 42) due to the pivot 32 and the rotational movement 40 of the lever 54 around the pivot 32. The lower portion is engaged with the closure member 30 and causes the closure member to displace laterally when the lower portion is displaced. For convenience, the upper portion of the lever 54 may be extended to a location proximate the operator so he/she may easily adjust the closure member 30 during operation.

However, it is not required that the actuator 34 be a lever 54 and pivot 32 as shown in FIG. 3. Any type of actuators may be used in keeping with the principles of this disclosure. For example, the actuator may be a remotely controlled electro-mechanical actuator 34 that adjusts the position of the closure member 30 relative to a position of a remote controller on the handle 52 of the device 50. Additionally, the actuator 34 may be a hydraulically actuated or electrically actuated solenoid that displaces the closure member 30 a predetermined distance relative to a hydraulic or electrical signal received from a remote controller. These are merely a few examples of the possible types of actuators that may be used to control a position of the closure member 30.

Figure 4:
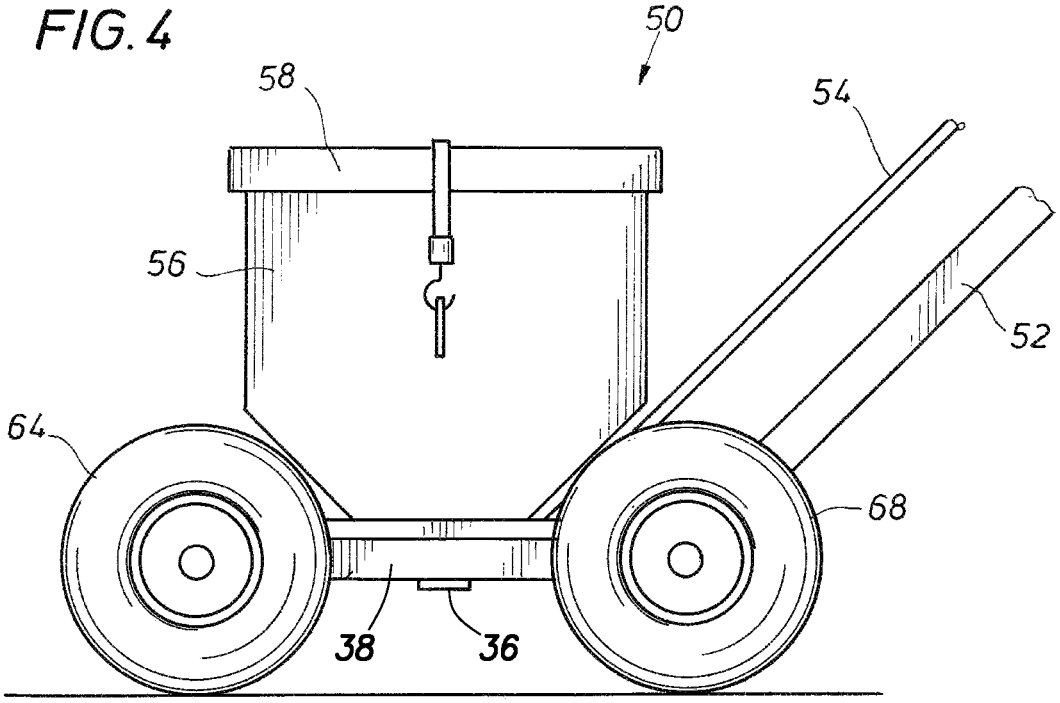
FIG. 4 is a representative side perspective view of the device with a lid.

Referring now to FIG. 4, the hopper 56 is shown with a lid 58 removably attached to a top of the hopper. This lid may prevent or at least reduce debris from entering the interior of the hopper 56. The lid 58 may also substantially prevent the granules stored within the hopper 56 from getting wet from falling water. The lid 58 is preferred, but it is not required for operation of the device 50 in keeping with the principles of this disclosure.

Referring now to FIGS. 5A-D, these figures illustrate the device 50 in several positions during operation of the device to cover the seams 20 with a line 60 of deposited granules 62. A similar sequence of device 50 positions may be needed to cover the cross-seams 24. FIGS. 5A-D are given as examples only. Several variations on the device 50 are possible in keeping with the principles of this disclosure. For example, the wheels 64, 68 could be replaced by a roller and track arrangement. This may be beneficial by spreading the weight of the device over a larger area of the roof, allowing for more granules to be carried in the hopper 56. Alternatively, or in addition to, more or fewer wheels may be used instead of those shown in FIGS. 5A-D.

The hopper 56 could also be various shapes as described above. The actuator 32 may be actuated manually, hydraulically, electrically, mechanically, etc. The actuator may include a hydraulically or electrically actuated solenoid, an electric motor, and/or concentric cables for displacing the closure member 30. The device may also be pulled along depositing granules 62 onto the roof. Therefore, it can readily be seen that many configurations of the device 50 are possible in keeping with the principles of this disclosure.

Referring again to FIG. 5A, the operator may partially fill the hopper 56 with granules 62 and position the device 50 over a seam 20 (or a cross-seam 24) of the build-up roofing system 10. The operator may then begin depositing granules 62 onto the roof 11 by adjusting the closure member 30 to a desired position via the actuator 34 (e.g. the lever 54), thereby selecting a desired width 66 of the line 60 of deposited granules 62. After the closure member 30 is displaced such that the valve 28 is at least partially open, the operator may apply a force 70 to the handle 52 and push the device 50 forward. The applied force 70 causes the granule-distributing device 50 to be propelled forward at a speed 72. Applying the force 70 to the device may also be called driving the device (or cart) 50.

The speed 72 in addition to the force of gravity determines an amount of granules 62 that are deposited along each unit length of the line 60. As the device 50 travels forward depositing granules 62, the device may come upon a cross-seam 24 (see FIG. 1) in the roofing system. A cross-seam 24 is a seam created between overlapping ends of cap sheets 16, where the cross-seam is generally perpendicular to the seam 20 being covered by the granules 62 from the device 50. However, it is not required that the cross-seam 24 be perpendicular to the seam 20. It is preferred that the wheels of the device 50 do not contact the cross-seam 24, because the weight of the device may be detrimental to the integrity of the cross-seam 24. However, it is not required that the device not contact the cross-seams 24 during the operation of depositing granules 62 over the seams 20.

Figure 5B:
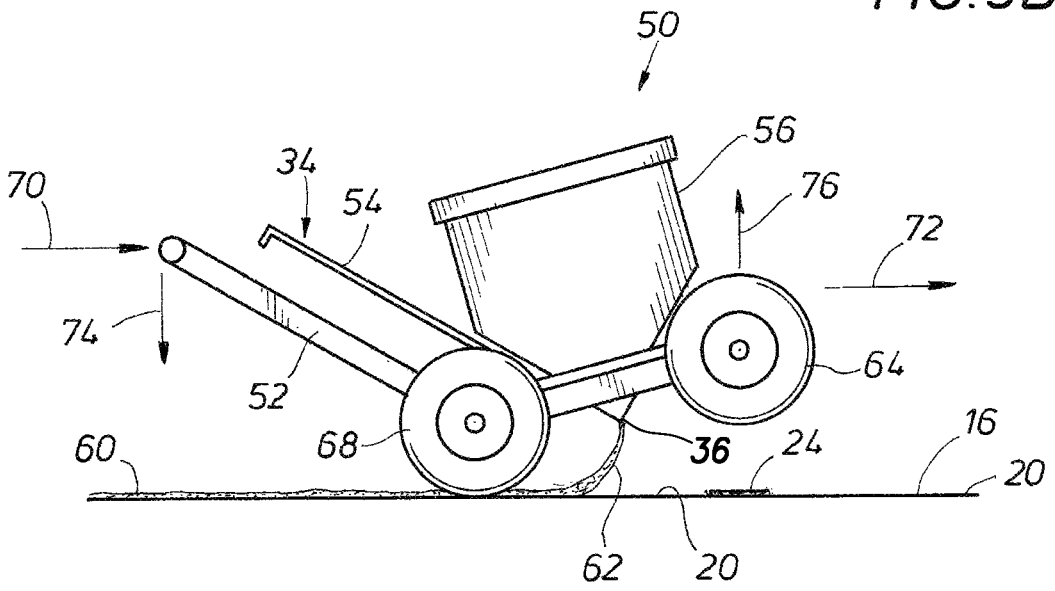

Preferably, when the device 50 encounters a cross-seam 24 the operator may apply a downward force 74 to the handle to raise the front wheels 64 upward off of the roof as indicated by arrow 76. As seen in FIG. 5B, the front wheels are raised and the operator continues to apply the force 70 to the handle 52 in order to maintain forward motion at the speed 72. With the front wheels 64 raised, the operator may avoid having the front wheels contact the cross-seam 24.

When the front wheels 64 of the device 50 are past the cross-seam 24, then the operator may apply an upward force 78 to the handle 52. This force 78 causes the front wheels 64 downward to again contact the roof 11, and causes the rear wheels 68 to be raised in the direction indicated by the arrow 80 (see FIG. 5C). The operator continues to apply the forward force 70 to the handle 52 to maintain the forward speed 72. With the rear wheels 68 raised, the operator may avoid having the rear wheels contact the cross-seam 24.

Figure 5C:
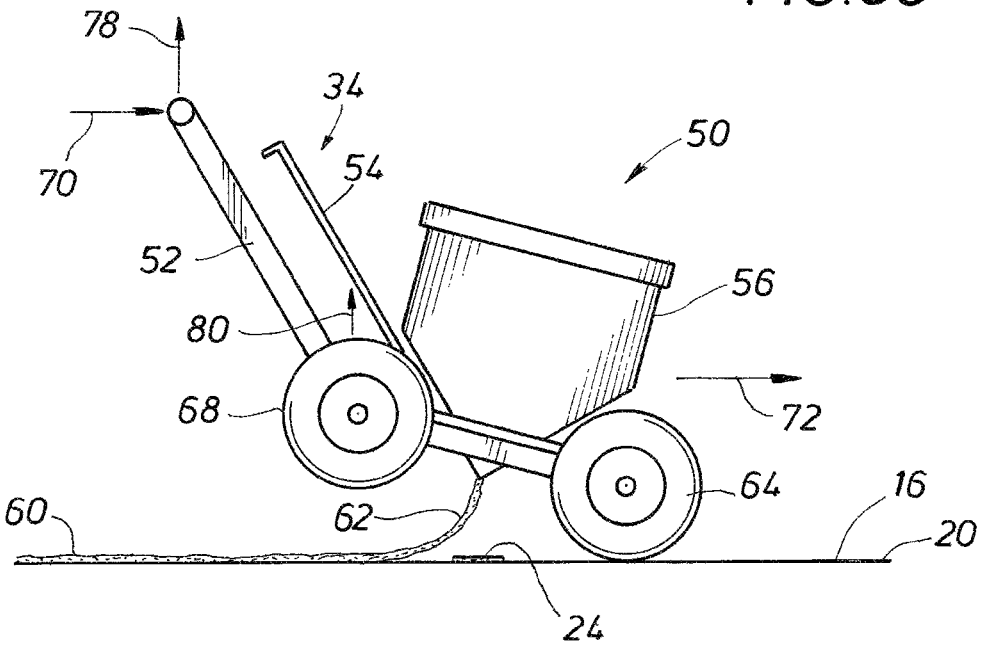
Figure 5D:
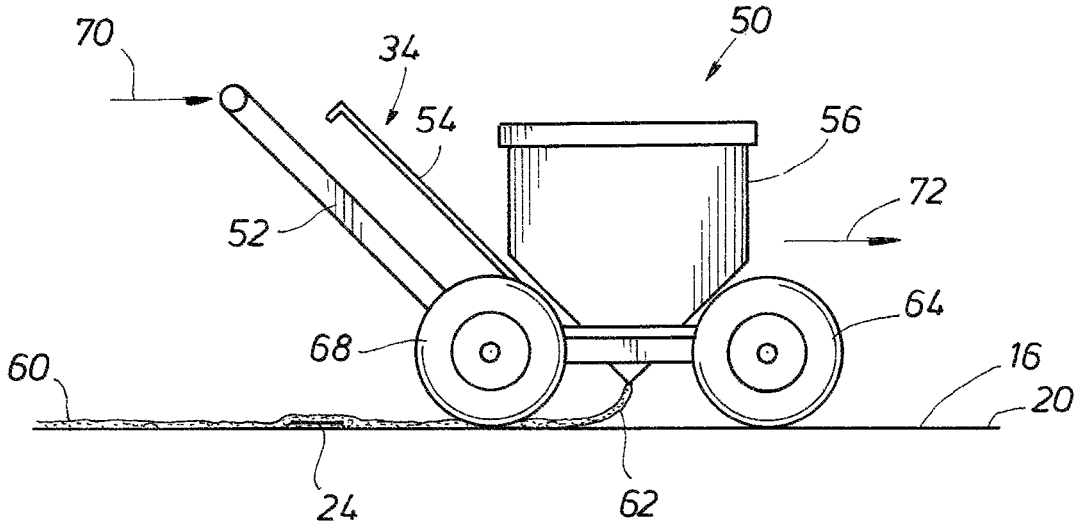

Once the rear wheels 68 have passed over the cross-seam 24, the operator can then remove the upward force 78 applied to the handle 52 and allow the rear wheels 68 to again contact the roof 11 (see FIG. 5D). As the device 50 travels forward, the speed 72 is preferably maintained and the width 66 of the deposited granules substantially remains unchanged, thereby depositing a line 60 of deposited granules 62 with a substantially uniform thickness and width 66 to cover the seams 20 of the roofing system.

However, it is not required that the forward speed 72 and the width 66 of the line be uniformly maintained. Either or both of these parameters (e.g. speed 72 and line width 66) may be varied during the sequence of events illustrated by FIGS. 5A-D.

Figure 6:
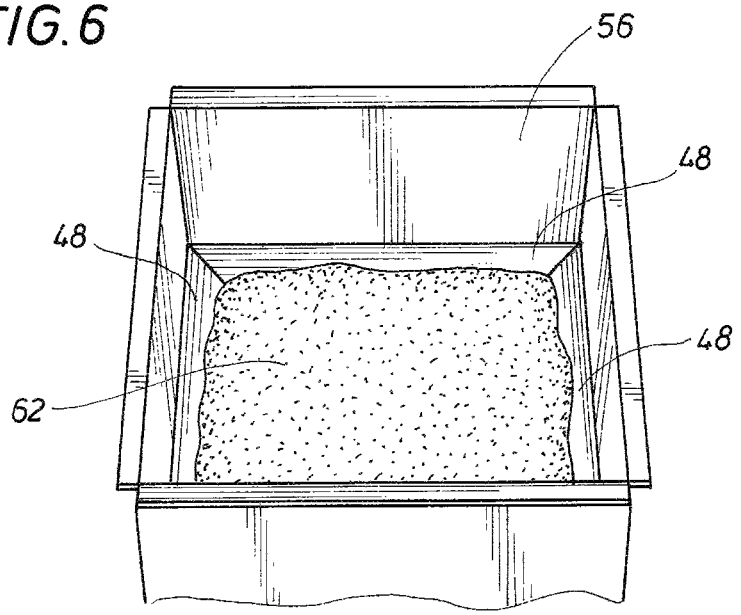
FIG. 6 is a representative top perspective view of the device partially filled with granules.

Referring now to FIG. 6, the hopper 56 is partially filled with granules 62. As can clearly be seen in FIG. 6, the interior walls 48 of the hopper's 56 lower portion are inclined toward the slotted exit 36 (see FIGS. 4 and 5B) to facilitate the removal of the granules 62 from the hopper 56 during operation when the valve 28 is at least partially opened.

Figure 7:
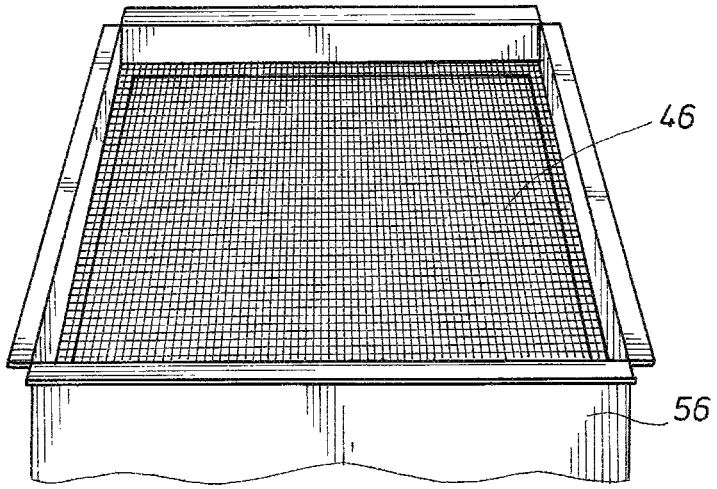
FIG. 7 is a representative top perspective view of the device with a screen installed.

Referring now to FIG. 7, a screen 46 is placed over an inlet to the hopper 56. The screen 46 may be used to filter out larger granules and/or foreign objects from entering the hopper 56. However, a screen 46 is not required for using the device 56 to cover the seams 20, 24 with loose granules 62.

Figure 8:
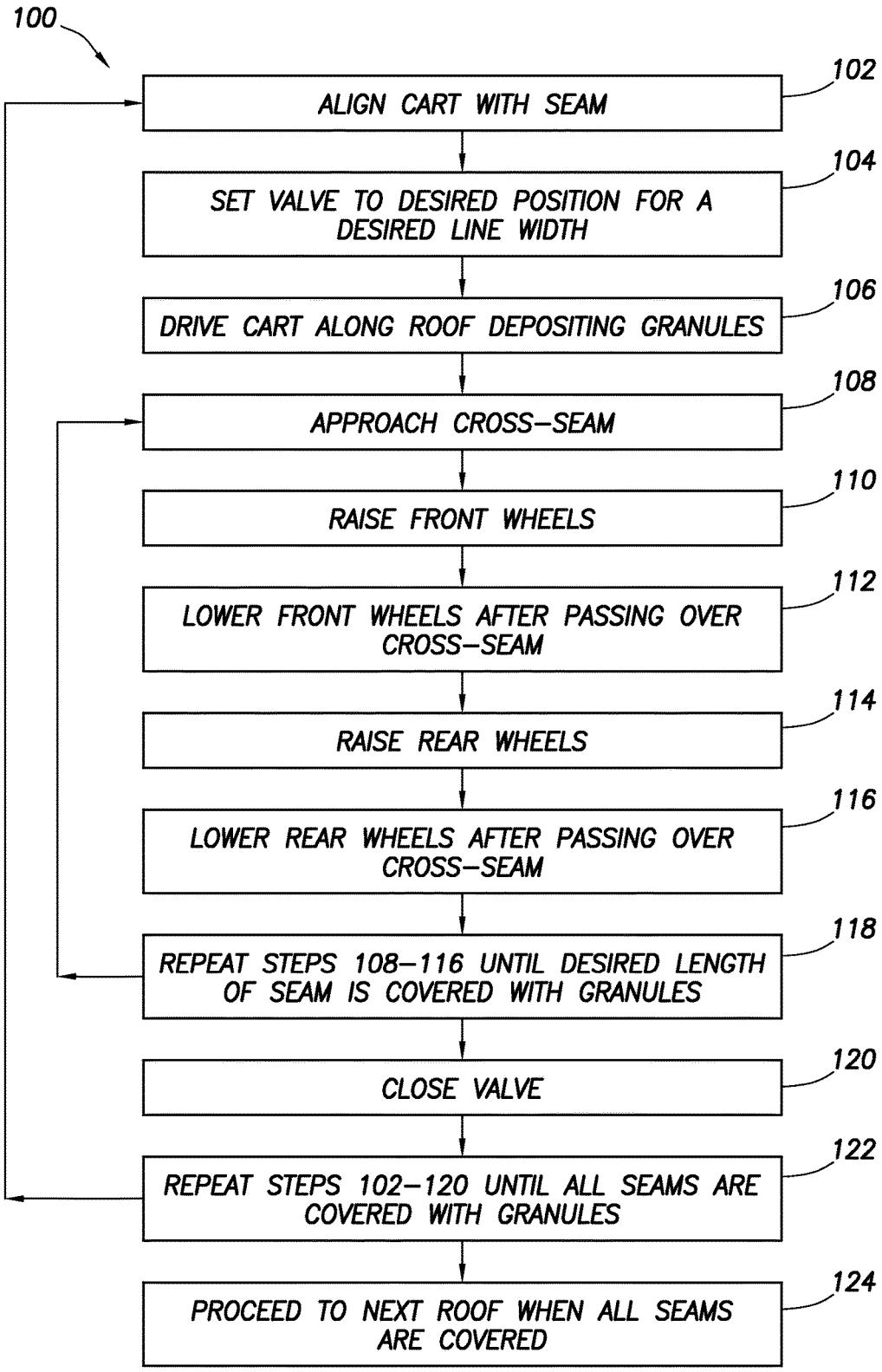
FIG. 8 is a representative flow chart for a method of distributing granules on a roof using the device (or cart) of FIG. 2.

A flow chart of process steps for a method 100 of distributing loose granules on a roof 11 to cover seams 20, 24 between cap sheets 16 of a build-up roof system 10 is representatively illustrated in FIG. 8. The method 100 may be used with the build-up roof system 10 described above to distribute loose granule on a roof 11 to cover seams 20, or the method may be used with other systems in keeping with the principles of this disclosure.

In step 102, an operator aligns the device 50 (which may also be referred to as a cart) with a seam 20 that needs a layer of loose granules 62 deposited over the seam to protect it from environmental conditions. In step 104, the operator adjusts the valve 28 on the device 50 so that a desired line width 66 of granules 62 is deposited over the seam 20. In step 106, the operator drives the device 50 (or cart) forward to begin depositing a line 60 of deposited granules 62 that begins covering the seam 20. In step 108, as the operator drives the device 50 along the seam 20, the device will approach a cross-seam 24.

It is preferred that the wheels 64, 68 do not apply pressure to the cross-seam 24 as the device 50 travels over the cross-seam. Therefore, the front wheels 64 and rear wheels 68 are lifted off the roof 11 separately as each set passes over the cross-seam 24.

In step 110, the operator applies a downward force 74 (in addition to the forward force 70) to the handle 52 may displace the handle 52 a predetermined distance downward, pivot the device 50 about the rear wheels 68 and lift the front wheels 64 off of the roof (see FIG. 5B). The operator continues to drive the device forward at the speed 72 and causes the lifted front wheels 64 to pass over the cross-seam 24, thereby preventing the front wheels from contacting the cross-seam. In step 112, the front wheels 64 have passed over the cross-seam 24 and the operator removes the downward force applied to the handle 52, thereby lowering the front wheels 64 into contact with the roof 11 again.

In step 114, as the rear wheels 68 approach the cross-seam 24, the operator applies an upward force 78 (in addition to the forward force 70) to the handle 52 which may displace the handle 52 a predetermined distance upward, pivot the device 50 about the front wheels 64 and lift the rear wheels 68 off of the roof (see FIG. 5C). The operator continues to drive the device forward at the speed 72 and causes the lifted rear wheels 68 to pass over the cross-seam 24, thereby preventing the rear wheels from contacting the cross-seam. In step 116, the rear wheels 68 have passed over the cross-seam 24 and the operator removes the upward force 78 applied to the handle 52, thereby lowering the rear wheels 68 into contact with the roof 11 again.

Several cross-seams may be encountered as the operator deposits loose granules 62 along the seam 20 to cover a desired length of the seam 20. The desired length is preferably the full length of the seam 20. However, it is not required that the operator cover the full length of the seam 20 in keeping with the principles of this disclosure. In step 118, the operator decides whether or not the desired length of the seam has been covered with the granules 62. If not, then steps 108 thru 116 are repeated until the desired length of the seam 20 is covered by the granules 62.

In step 120, if the operator determines that the desired length to the seam 20 has been covered, then the operator closes the valve to prevent unwanted distribution of loose granules 62 on the roof 11. In step 122, the operator determines if a desired amount of seams have been covered with the loose granules 62. It is preferable that all seams 20 are covered by the granules 62, but it is not required that all seams 20 be covered in keeping with the principles of this disclosure. If the desired amount of seams 20 have been covered, then the operator can then proceed to another roof 11, if desired.

The method 100, given above, specifically describes covering seams 20 with the loose granules while passing over cross-seams 24. However, the method may also be applied to covering cross-seams 24. In modifying the method to cover the cross-seams 24 with loose granules 62, the cross-seams would replace the instances of the seams 20 in the method, and the seams 20 would be passed over instead the cross-seams 24. In this way, all seams (including seams 20 and cross-seams 24) may be covered by the loose granules 62 before proceeding to another roof 11.

It will now be fully appreciated that the above disclosure provides several advancements to the art of roofing systems.

It is to be understood that the various examples described above may be utilized in various orientations, such as inclined, horizontal, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction away from the roof's surface, and "below," "lower," "downward" and similar terms refer to a direction toward the roof's surface.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A device for depositing granules on a roof, the device comprising:

a hopper which is at least partially filled with the granules, wherein the hopper is configured to deposit the granules onto bonding material that has been oozed from a seam between adjacent sheets of roofing material;

a valve which selectively opens and closes, wherein the granules stored in the hopper flow through the valve in response to gravity when the valve is at least partially open, wherein flow of the granules from the hopper is not assisted by any of an agitator, an auger, and air pressure, wherein the valve comprises a closure member and an actuator, wherein the actuator is a lever pivotally mounted to the hopper and lateral displacement of the lever laterally displaces the closure member in an opposite direction, and wherein the actuator displaces the closure member to various lateral positions between and including opened and closed positions, thereby adjusting a width of the granules that exit the hopper through the valve; and a chassis that includes the hopper, at least one front wheel, at least one rear wheel, and a handle mounted to the chassis, wherein the wheels are rotatably mounted to the chassis, and wherein the handle is configured to selectively raise the front wheel or the rear wheel from the roof.

2. The device of claim 1, wherein at least one interior wall of the hopper is slopped toward an exit in a bottom of the hopper, and wherein the gravity urges a portion of the granules along the slope toward the exit.

3. The device of claim 1, wherein interior walls of the hopper form one of a circular, a rectangular, and an oval cross-section.

4. The device of claim 1, wherein displacement of the handle downward a predetermined distance raises the front wheel off the roof, and displacement of the handle upward another predetermined distance lowers the front wheel onto the roof and raises the rear wheel off the roof.

5. A device for depositing granules on a roof, the device comprising:

a hopper which is at least partially filled with the granules, wherein the hopper is configured to deposit the granules onto bonding material that has been oozed from a seam between adjacent sheets of roofing material;

a valve which selectively opens and closes, wherein the granules stored in the hopper flow through the valve in response to gravity when the valve is at least partially open, and wherein flow of the granules from the hopper is not assisted by any of an agitator, an auger, and air pressure, wherein the valve comprises a closure member and an actuator, wherein the actuator is a lever pivotally mounted to the hopper and lateral displacement of the lever laterally displaces the closure member in an opposite direction, and wherein the actuator displaces the closure member to various lateral positions between and including opened and closed positions, thereby adjusting a width of the granules that exit the hopper through the valve; and a chassis that includes the hopper, two front wheels, two rear wheels, and a handle mounted to the chassis, wherein the wheels are rotatably mounted to the chassis, and wherein the handle is configured to selectively raise the two front wheels or the two rear wheels from the roof without roof damage caused by any of the front and rear wheels.

* * * * *